United States Patent [19]

Walendowski

[11] Patent Number: 4,989,785

[45] Date of Patent: Feb. 5, 1991

[54] METHOD OF AND APPARATUS FOR WATER JET CLEANING

[76] Inventor: Stanley J. Walendowski, P.O. Box 587, Marine City, Mich. 48039

[21] Appl. No.: 194,789

[22] Filed: May 17, 1988

Related U.S. Application Data

[63] Continuation-in-part of Ser. No. 824,155, Jan. 30, 1986, abandoned.

[51] Int. Cl.[5] ..... B05B 3/12

[52] U.S. Cl. ..... 239/227; 239/244; 239/263.3; 118/70; 118/323

[58] Field of Search ..... 239/225.1, 231, 227, 239/239, 240–242, 263–263.3, 264, 288–288.5, 275, 243, 244; 118/70, 323, 324, 697; 198/494, 495; 134/172, 180, 181, 123, 56 R, 45

[56] References Cited

U.S. PATENT DOCUMENTS

| | | | |
|---|---|---|---|
| 1,592,452 | 7/1926 | Ferris et al. | 239/243 X |
| 1,657,990 | 1/1928 | Blouin | 239/227 |
| 2,719,529 | 10/1955 | Wells | 239/263.1 X |
| 2,732,846 | 1/1956 | Berezny | 239/288.3 X |
| 2,974,631 | 3/1961 | Thompson | 198/494 X |
| 3,443,993 | 5/1969 | Lynn et al. | 134/181 X |
| 3,510,352 | 5/1970 | Neuman | 134/45 |
| 3,543,774 | 12/1970 | Trasp | 134/181 X |
| 3,709,190 | 1/1973 | Von Gottberg et al. | 118/323 X |
| 3,747,854 | 7/1973 | Anderson | 239/227 |
| 4,069,790 | 1/1978 | Witte | 198/494 X |
| 4,076,033 | 2/1978 | Busse et al. | 118/323 X |
| 4,498,414 | 2/1985 | Kiba et al. | 118/323 X |
| 4,664,720 | 5/1987 | Rucker | 239/227 X |
| 4,777,972 | 10/1988 | Adam | 198/495 X |
| 4,895,307 | 1/1990 | Swinehart et al. | 239/263.1 X |
| 4,905,913 | 3/1990 | Frikker | 239/263.1 X |

FOREIGN PATENT DOCUMENTS

| | | | |
|---|---|---|---|
| 1965345 | 12/1969 | Fed. Rep. of Germany | 239/243 |
| 357104 | 11/1972 | U.S.S.R. | 134/123 |
| 797929 | 1/1981 | U.S.S.R. | 134/123 |
| 750784 | 6/1956 | United Kingdom | 239/227 |

*Primary Examiner*—Andres Kashnikow
*Assistant Examiner*—Kevin Weldon
*Attorney, Agent, or Firm*—Brooks & Kushman

[57] ABSTRACT

A method and apparatus for a high pressure water jet automatic cleaning station for dollies or the like disclosed comprises a plurality of high pressure nozzles (152) displaced radially and also being rotatable about independent axes A. The independent axes A are arranged in radially spaced parallel relation about a central axis C. A support (158) mounts the nozzles (152) for rotation about the independent axes A and also mounts the independent axes A for revolution about the central axis C. A driver (160) revolves the independent axes A whereby the nozzles (152) provide jets of water whose impingement patterns create a uniform dense water cleaning spray. A programmer controls movement of the nozzles (152) to cause the jets to impinge on preselected areas of the dollies.

18 Claims, 8 Drawing Sheets

METHOD OF AND APPARATUS FOR WATER JET CLEANING

CROSS-REFERENCE TO RELATED APPLICATION

This application is a continuation-in-part of U.S. Ser. No. 824,155 now abandoned for Method of And Apparatus for Water Jet Cleaning filed on Jan. 30, 1986 in the name of Stanley Walendowski.

TECHNICAL FIELD

This invention relates to method of and apparatus for cleaning articles utilizing high pressure water jets.

BACKGROUND OF INVENTION

High pressure water cleaning has numerous applications for removing unwanted contaminants and/or surface layers from an object's surface. For example, high pressure water cleaning is used to remove rust from metallic surfaces, paint and accumulated paint from various surfaces, and layers of surface concrete from its underlying aggregate.

Various types of apparatus have been developed for industrial cleaning of parts using high pressure water jets, i.e., where water pressure on the order of 10,000 PSI or more are involved. One important application is the stripping of paint from automobile body dollies so that the paint accumulation does not build up to the point where it may flake off and contaminate the painted surface of the vehicle. Such contamination of the surface is a source of considerable expense and there has been a need in the auto industry to clean the body supporting dollies to avoid such contamination. Heretofore such cleaning has been carried out manually by having workmen armed with a high pressure jet gun manually go over the dollies to strip the paint accumulation therefrom. This, of course, is a labor-intensive operation and therefore the need has arisen to accomplish this automatically.

My experimentation has indicated that while automatic paint stripping using high-pressure water jets appears feasible, being able to control the area of impingement of the jets so that all intended surfaces of the dollies could be stripped proved to be quite difficult. Following considerable experimentation, I discovered that in order for automatic stripping to be carried out satisfactorily certain parameters in the design of the equipment are essential, and as far as I am aware, such have never before been suggested as being necessary for this type of cleaning operation.

In addition, dollies which move continually through the automobile body painting operation may have only been cleaned by taking them out of the system for manual cleaning. This tends to be disruptive of the system and an improved arrangement has been needed for some time.

Conventional apparatus for high pressure water cleaning have included use of a plurality of high pressure water nozzles radially spaced about a common axis for rotation. The nozzles are typically rotated about the common axis to create a circular jet of water. The common axis is moved relative to a surface to be cleaned so that the circular pattern of jet impingement sweeps the surface. If the movement of the common axis (about which the nozzles rotate) is slow enough relative to the surface being swept, the jets will impinge on essentially every portion of such surface and it will be completely cleaned. However, the movement of the common axis would be so slow that the efficiency of the cleaning operation would be unacceptable for use in a production line environment such as the cleaning of automobile body supporting dollies on a body painting line.

DISCLOSURE OF INVENTION

An object of the present invention is to provide an improved method of and apparatus for water jet cleaning which provides a uniform dense water cleaning spray to clean all types of articles. In particular, the apparatus can be computer controlled, put into a paint cleaning station and programmed ,to strip paint from automobile body dollies so that the paint accumulation does not build up to the point where it may flake off and contaminate the painted surface of a vehicle painted on the dolly.

In carrying out the above object, the improved apparatus comprises a high pressure nozzle having inlet and discharge ends. The nozzle discharge end is displaced radially from an axis about which it rotates. Several independent nozzle axes are arranged in radially spaced relation about a central axis. A support mounts the nozzles for rotation about the independent axes and for revolution about the central axis. A drive means revolves the independent axes about the central axis and also rotates the nozzles about the independent axes whereby the discharge ends provide jets of water whose impingement pattern creates a uniform dense cleaning spray. The water jet pattern which will impinge on every portion of a surface against which the spray is directed to completely clean the same either without advancing the common axis of the jets over the surface, or during a relatively rapid advance, such as the rate of 12 feet per minute.

In a preferred embodiment, the individual nozzles are rotated about their independent axis 2.1 times for each revolution of the independent axis about the common axis of revolution. This relative rotational speed can be varied to suit various application requirements.

I have found that articles may be cleaned with the high pressure water jets completely and automatically by directing the substantially parallel jets of high pressure water at the surface to be cleaned while rotating the streams about an axis extending parallel to and disposed between them and tilting the streams about X and Y axes disposed substantially perpendicular to the axis of rotation thereby to direct streams quite accurately at preselected areas of the surface to be cleaned. A compound movement of the jet streams may be effected whereby accurate control of the location of impingement of the jets on the article to be cleaned may be attained. Such an apparatus can be used in a cleaning station of the type used for stripping paint from automobile body dollies. A programmable computer control is supplied and relative movement of the dolly to be cleaned and the jets can be controlled whereby a discrete portion of the dolly is cleaned each time it passes through the cleaning station. The relative movement is programmable to provide movement in a generally linear and perpendicular fashion with respect to the area impinged by the jets to clean an elongated area along the dolly. The jets are programmably repositionable so that after a number of consecutive passes of the dolly through the cleaning station, the entire dolly is cleaned.

As a result of the control of the nozzles under the command of the computer, the coverage of the part upon which the jets impinge may be complete and accurate. For example, automobile body supporting dollies in a painting system may be diverted through the cleaning station during their travel through the system and as each dolly passes through the cleaning station a preselected area thereof may be cleaned before the dolly is passed back into the painting system. On the next pass through the cleaning station another preselected area of the dolly may be cleaned and in like fashion on each successive pass through the station successively different areas of the dolly may be cleaned until the entire preselected areas have been thus stripped of accumulated paint. As a consequence, the dollies are not completely cleaned in one operation as has been heretofore accomplished manually, but rather are cleaned in part and by successive passes are eventually completely cleaned. The programmed cleaning can, of course, concentrate on areas of the dolly subject to the most rapid accumulation of paint build up.

The objects, features, and advantages of the present invention are readily apparent from the following detailed description of the best mode for carrying out the invention when taken with the accompanying drawings.

BEST MODE FOR CARRYING OUT THE INVENTION

Figure 1:
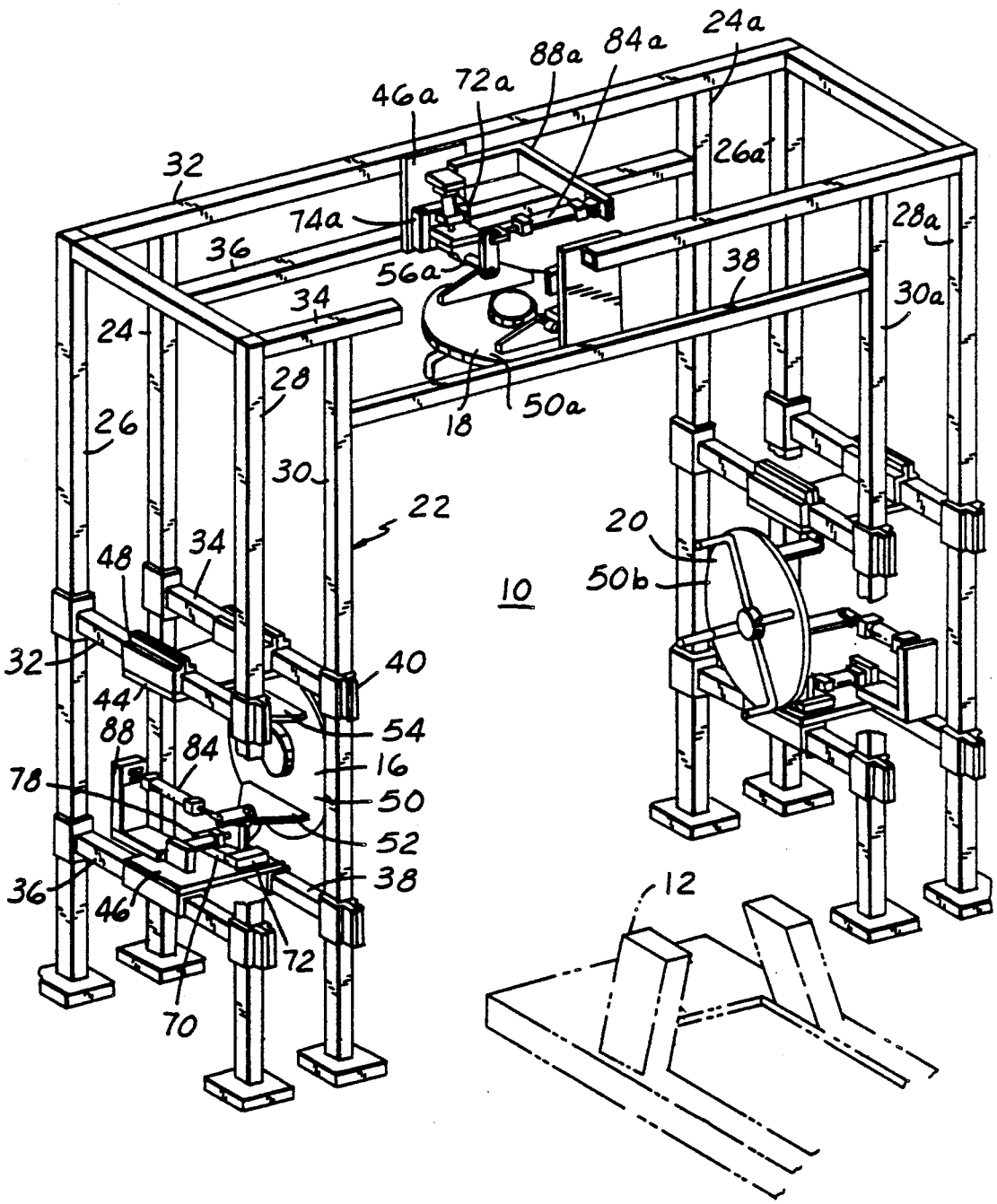
FIG. 1 is a perspective view, with parts broken away, to illustrate a cleaning station for article supporting dollies, which station may be positioned along the line of travel of the dollies.
Figure 2:
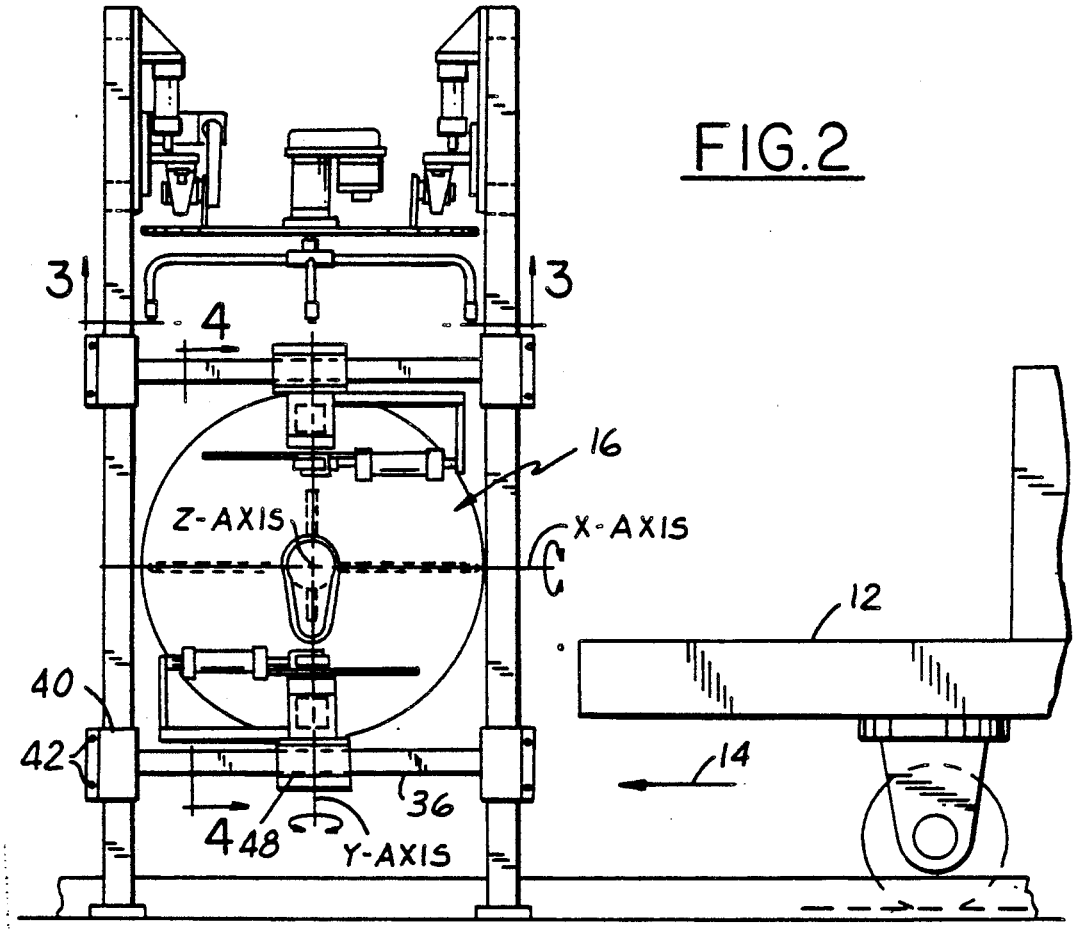
FIG. 2 is a side elevation of the cleaning station shown in FIG. 1.

The invention is illustrated in conjunction with an automatic dolly cleaning station 10 such as may be provided in an automotive assembly plant. A dolly 12 is shown in FIGS. 1 and 2 which may move through the station in the direction of arrow 14 being propelled by a conveyor mechanism not shown. In a preferred arrangement, the cleaning station 10 is simply another station along the processing line and dollies would enter and leave it as they pass through the system. In one arrangement, a dolly might enter station 10 shortly after an automobile body it had been carrying is removed and before another body is loaded thereon for transport through the painting system.

As dolly 12 enters the station, its presence is sensed by means not shown to signal the station that cleaning is to commence. Thereupon several nozzle assemblies are activated, three being shown at 16, 18, and 20, to cause streams or jets of high-pressure water to be directed against the dolly to strip accumulated paint therefrom. Each nozzle assembly is under the control of a controller so that the area of impingement of the jets is accurately controlled. The reason this is important is that the surfaces of the dolly to be cleaned often involve many inside angles and corners and unless the jets are directed with precision, these areas will not be cleaned.

Because of the high pressures involved and the necessity to periodically alter the location of the nozzle assemblies to accommodate changes in dolly design particularly at model change over times, the station must be provided with a strong and rigid framework 22. Desirably, this may comprise four vertical parallel tubes 24, 26, 28, and 30 at one side and companion tubes similarly numbered with alpha suffixes at the other side. The sides are tied together by four parallel horizontal tubes 32, 34, 36, and 38. Lower ends of the vertical tubes are secured to the floor in any suitable fashion. The tubes are desirably welded together at their meeting ends.

The nozzle assemblies mounted on the frame 22 are of similar construction and therefore a description of assembly 16 will suffice for all. The nozzle assembly is mounted on the frame 22 by means of four cross members 32, 34, 36, and 38 at opposite ends of which are split collars 40 preferably affixed by welding. The split collars embrace the tubes and may be adjustably clamped thereto by bolts 42 whereby the cross members may be positioned or repositioned as needed to adjust the location of each nozzle assembly along the vertical and horizontal tubes. Mounted on the cross members are carriers 44 and 46 having welded thereto split collars 48, similar to collars 40 and similarly secured to permit adjustment of the nozzle assembly longitudinally (along the path of travel of dolly 12).

The nozzle assembly includes a circular trunnion plate or base member 50, which also functions somewhat as a shield between the nozzles and their angle adjusting means hereinafter described. The trunnion plate 50 is provided with a pair of mounting webs or brackets 52 and 54 to which are rigidly connected mounting and control shafts 56 and 58. The shafts are carried by pillow blocks 60 and 62 of the type that will permit relative angulation between the shaft and the pads 64 and 66 on which the pillow blocks are mounted.

Pads 64 and 66 are secured to sliders 68 and 70 mounted for sliding movement between guideways 72 and 74.

Figure 6:
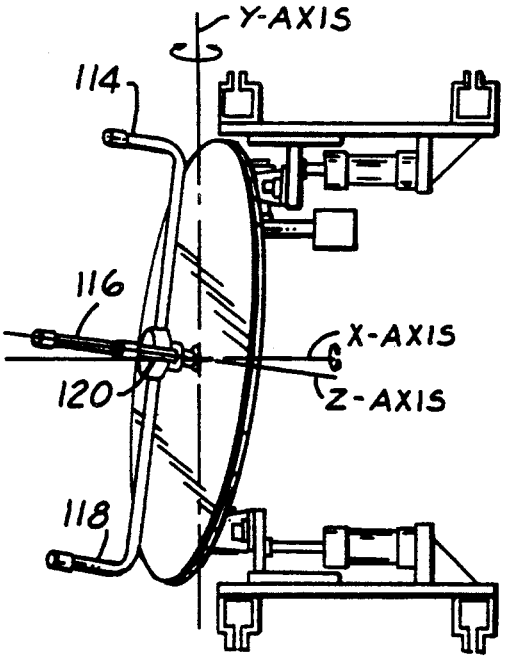
FIGS. 6 and 7 illustrate various positions to which a nozzle assembly may be tilted about its X and Y axes.
Figure 7:
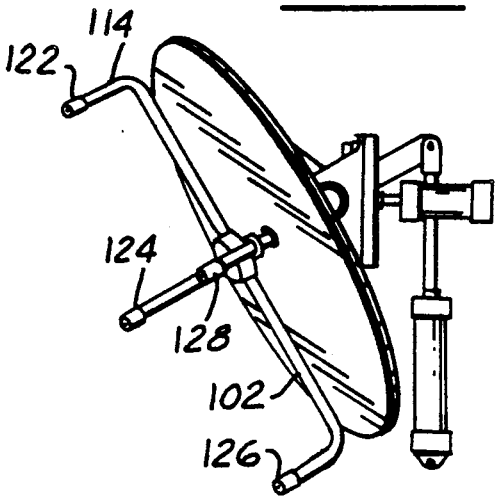

A pair of fluid pressure actuators 76 and 78 have a piston rod connected to pads 64 and 66 while the other end of the actuator is mounted to brackets 80 and 82 secured to the carriers 44. By selectively pressuring the actuators 76 and 78, the trunnion plate 50 may be pivoted about a geometric X axis as shown in FIG. 6. Pivoting of the trunnion plate 50 about the Y axis is permitted by the rotation of shafts 56 and 58. Control over the Y axis pivoting is provided by a fluid pressure actuator 84 whose piston rod is connected to crank arm 86 rigidly connected to a shaft 56 (and in turn to the web 52) with the other end of the actuator connected to an L shaped bracket 88 secured to the carrier 46.

Figure 3:
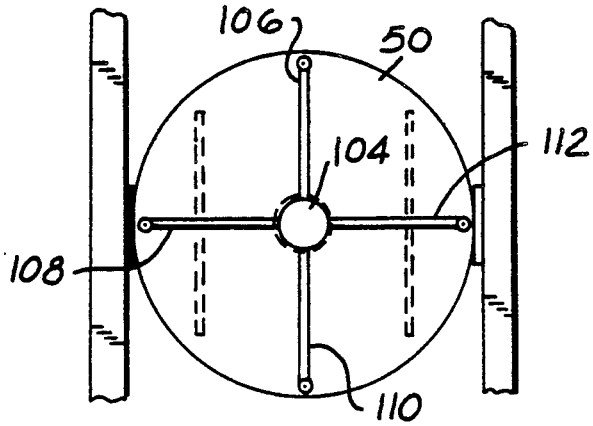
FIG. 3 is a view of a nozzle assembly taken substantially on the line 3—3 of FIG. 2.

Mounted on the rear side of shield or trunnion plate 50 is a high pressure swivel 90 such as available from Butterworth, Inc. of 3721 Lapas Drive, Houston, Texas, under part No. 35-10000 which is driven by fluid pressure motor 92 through a suitable drive train 94. A fluid pressure inlet 96 is connected to a high pressure line 98 (FIG. 8) from a control valve 100. The swivel and motor 92 serve to deliver high pressure water to a conduit 102 mounted in the swivel for rotation thereby and extending through the trunnion plate 50. A hub 104 on the conduit supports four nozzle pipes 106, 108, 110, and 112 as shown in FIG. 3 which are arranged to radiate from the hub at 90 degrees from each other. The ends of the pipes are turned at 90 degrees to provide nozzle mounting ends 114, 116, 118, and 120 each of which supports a high pressure water jet nozzle 122, 124, 126, and 128. The nozzles are thus arranged radially around the axis of rotation of conduit 102 to deliver high pressure water jets or streams along axes substantially parallel to the axis of rotation. Such axis of rotation corresponds to the geometric Z axis in relation to the previously mentioned X and Y axes. Such is illustrated generally in FIG. 6.

Figure 8:
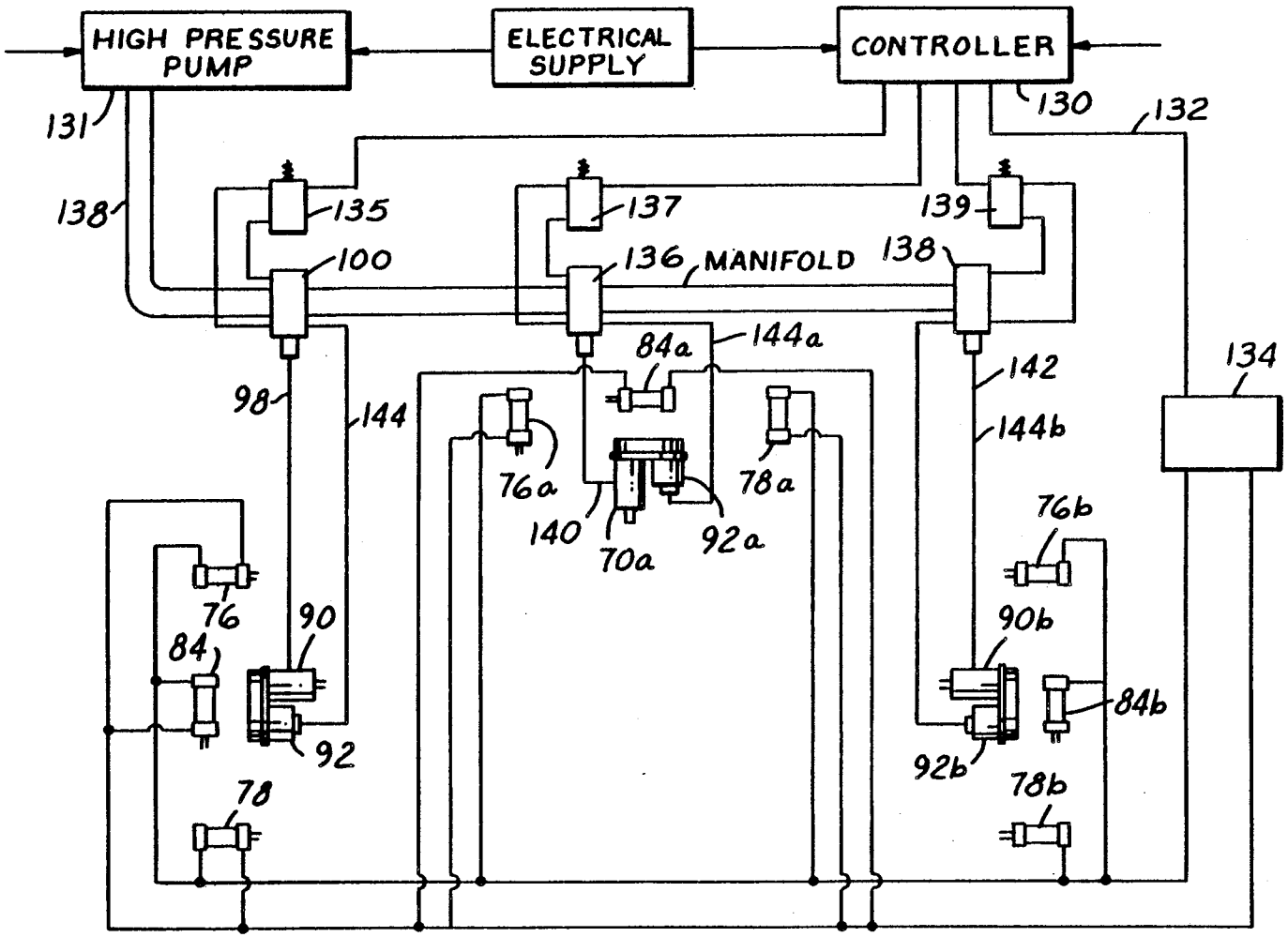
FIG. 8 is a schematic diagram showing the fluid pressure and control lines for the apparatus of FIG. 1.

The high pressure streams from the nozzles are directed to impinge on preselected areas of the dolly 12 and sweep such areas to remove accumulated paint coatings or the like therefrom. Where the dollies are part of a continuous conveyor system such as may be used in an automobile body painting system, I contemplate that as each dolly is unloaded it will pass through the station 10 before a body to be painted is loaded thereon, and in station 10 the nozzles will serve to direct their streams at selected areas of the dolly. Thus, each time the dollies pass through station 10, given areas will be cleaned, and on successive passes the positions of the nozzles are automatically adjusted so that different areas will be cleaned until, after the dollies have passed through several times, all areas will have been cleaned. Thus, by cleaning only a portion of the dolly on each pass, but cleaning different portions on successive passes, all of the dollies are eventually cleaned without the necessity of pulling them out of the system, and the cleaning is carried out at the normal conveyor speed, which may be on the order of 15 to 16 feet per minute. In order to effect this sequential cleaning of selected areas of the dollies on successive passes through the station, a controller 130 shown schematically in FIG. 8 is programmed to effect tilting of the nozzle assembly about its X and Y axis. The controller may be one of several types such as made by Square D or Allen Bradley and is programmable with a memory. Programming is generally carried out by aiming the nozzle assemblies 16, 18, and 20 at the various selected surfaces for each pass of the dolly and testing the jet pattern and effectiveness at each setting and then programming the controller to repeat the settings. Means (not shown) sensing the presence or absence of a dolly in the station is connected to the controller to initiate its operation.

The controller 130 has an output 132 to a four-way air pressure control 134 which is connected to the fluid pressure actuators 76, 78, and 84 at each nozzle assembly whereby signals from the controller will serve to pressurize the actuators.

A high pressure water pump 136 has a manifold line 138 which extends to air operated control valves 100, 136, and 138 which are controlled by the controller 130 through solenoid three-way air valves 135, 137, and 139. High pressure water delivery lines 98 and 140 and 142 extend to the swivels. Air under pressure for the motors 92, **92*a* and 92*b* is delivered by the lines 144, 144*a* and 144*b* which are connected to the air delivered to the valves 100, 136, and 138. Thus, where the valves 100, 136, and 138 are pressurized to deliver water to the nozzle assemblies, the air motors 92, 92*a* and 92*b*** are activated.

With reference to FIGS. 9 through 13 of the drawings, a preferred nozzle apparatus substitutable for nozzle assemblies 16, 18, and 20 shown in FIGS. 1 through 7 constructed in accordance with the present invention is generally indicated by 150.

Figure 9:
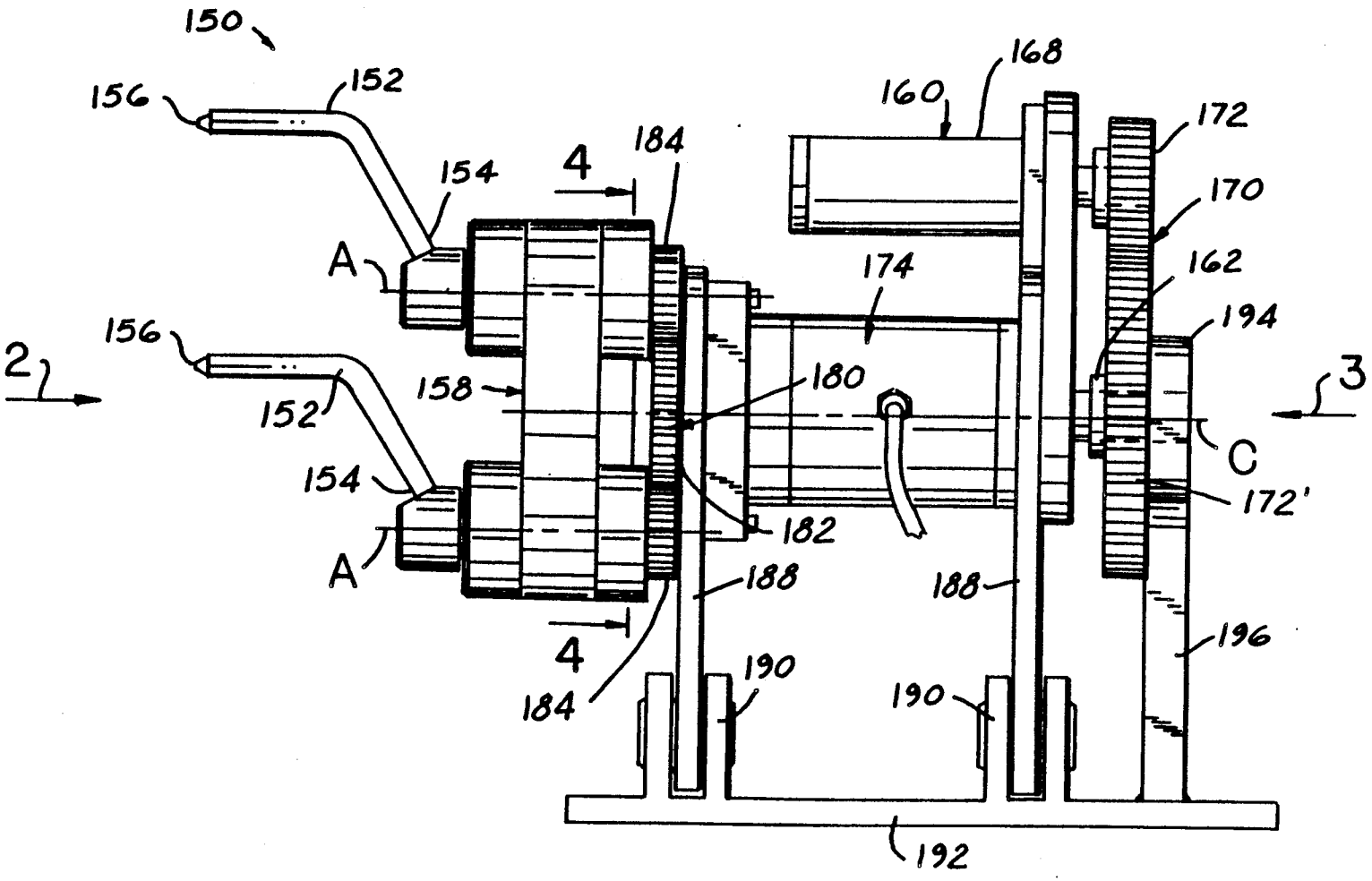
FIG. 9 is a side elevation of an apparatus for high pressure water cleaning constructed in accordance with the present invention.
Figure 11:
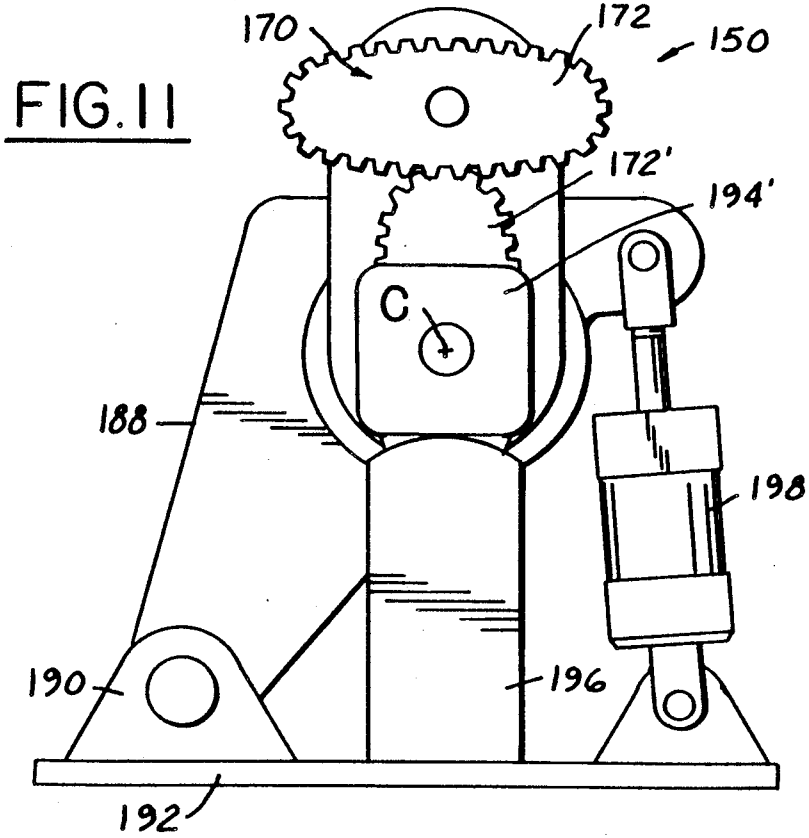
FIG. 11 is a rear elevation taken in the direction of arrow 3 in FIG. 9 illustrating elliptical transmission gearing and cam pivotal mounting of the distribution head.
Figure 10:
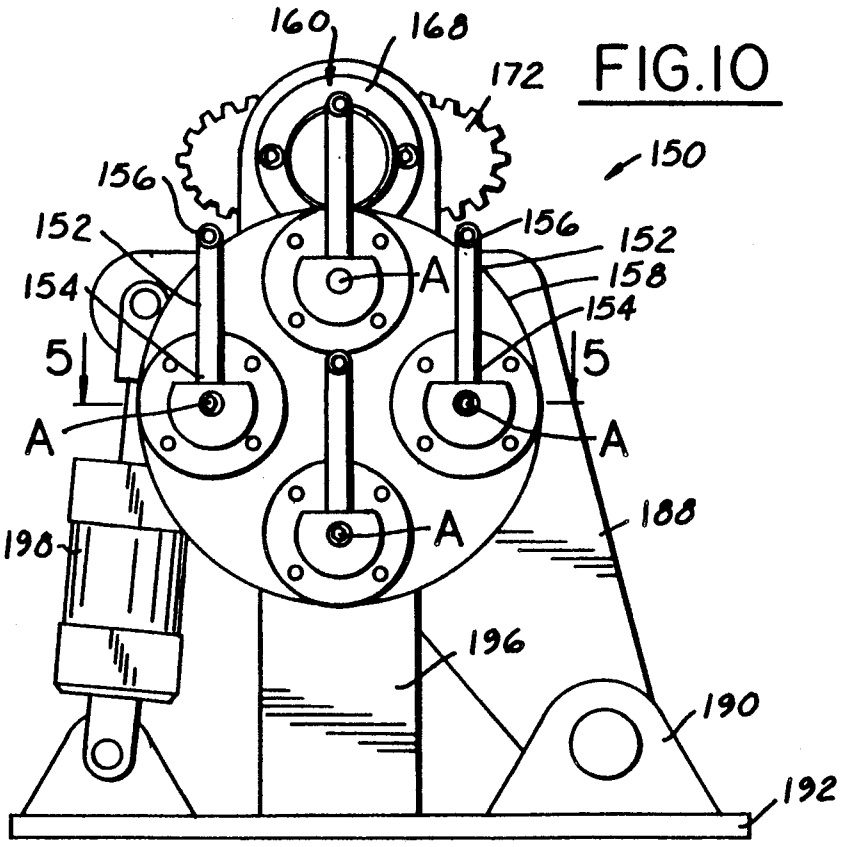
FIG. 10 is a front elevation taken in the direction of arrow 2 in FIG. 9 and illustrating four nozzles circumferentially mounted on a multiple orifice distribution head.
Figure 12:
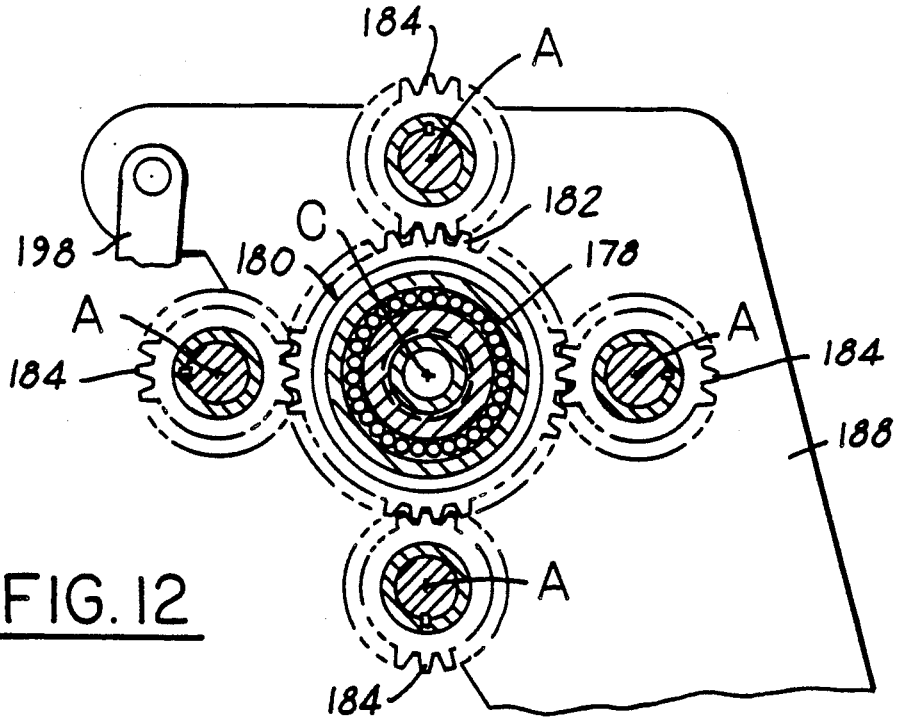
FIG. 12 is a cross-sectional view taken along lines 12—12 in FIG. 9 illustrating gearing which rotates the nozzles about independent axes and revolves the nozzles about a common axis.
Figure 13:
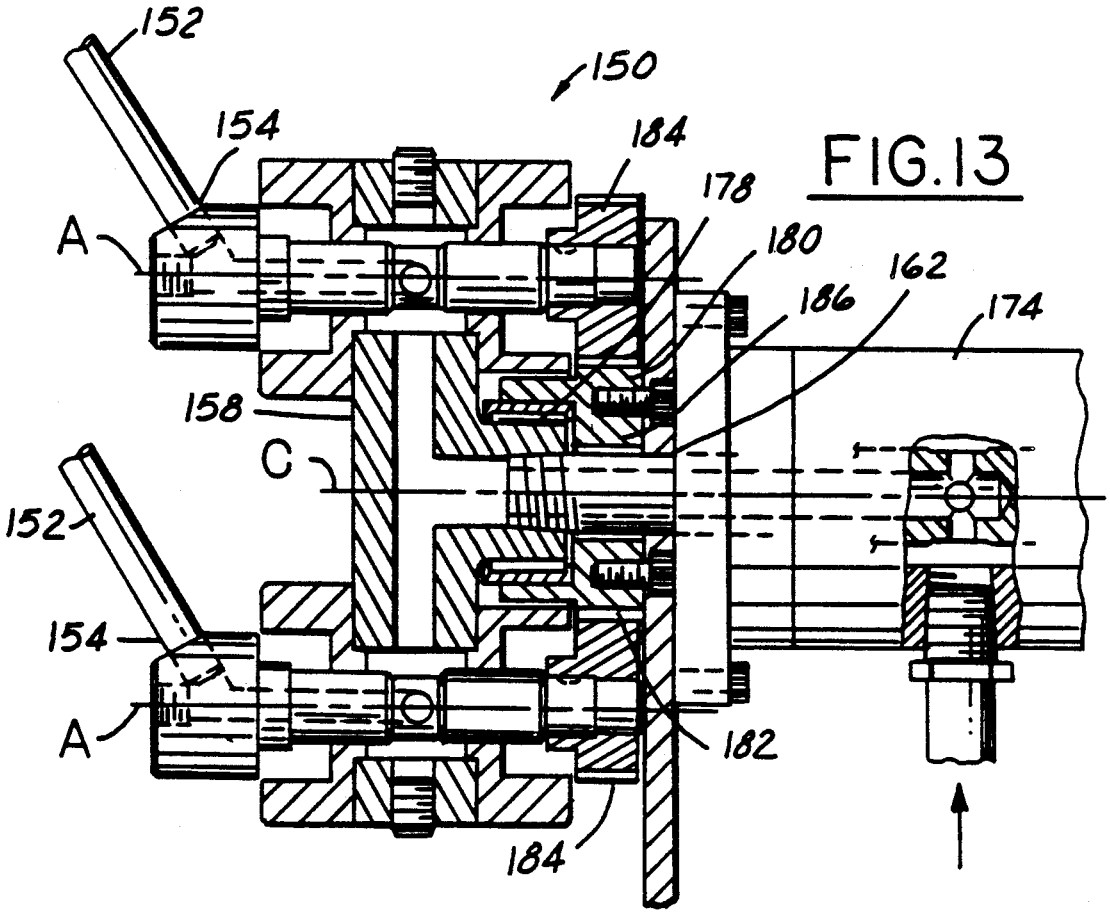
FIG. 13 is a cross-sectional view taken along line 13—13 in FIG. 10 illustrating the routing of high pressure water through a water swivel and subsequently through the multiple orifice distribution head.

As shown in FIGS. 9 and 10 of the drawings, the apparatus 150 comprises a plurality of high pressure nozzles 152 having inlet and discharge ends 154 and 156. Each nozzle discharge end 156 is displaced radially and also is rotatable about an independent axis A. The independent axes A are arranged in radially spaced relation about a central axis C. A support 158, shown here as a multiple orifice distribution head, mounts the nozzles 152 for rotation about independent axes A and also mounts the independent axes for revolution about the central axis C. A drive 160 revolves the independent axes A about the central axis C whereby the discharge ends 156 provide substantially parallel jets of high pressure water which impinge on the dolly to create an impingement pattern as shown by the computer simulated pattern of FIG. 14. The jets of water cross one another as the nozzles 152 are rotated and revolved to create a uniform dense water impingement pattern such that it is possible to thoroughly clean the surface area in front of the jets.

Figure 14:
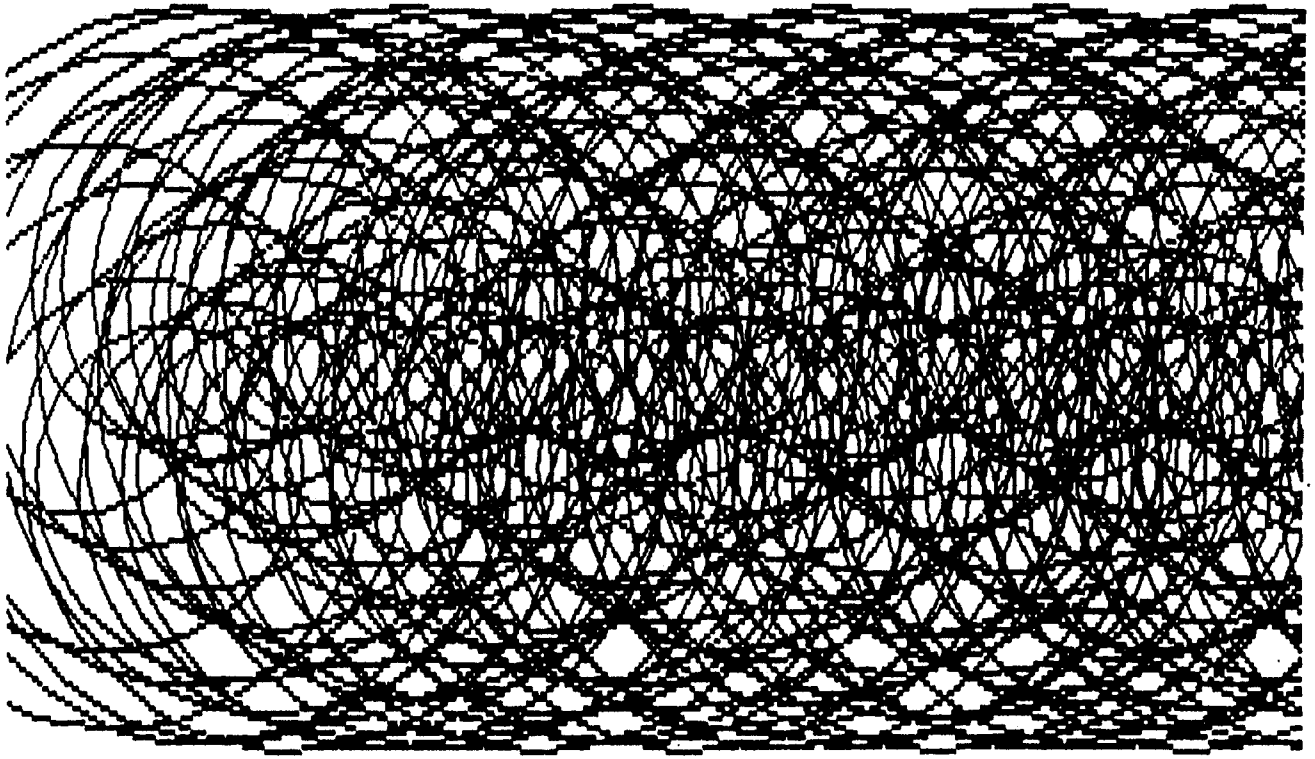
FIG. 14 is a computer generated simulation typical of the water jet impingement pattern that results from use of the invention herein disclosed.

In FIG. 14, the jet pattern is being moved linearly at the rate of 12 FPM and the assembly is revolving at 100 RPM. Each nozzle 152 is rotating at a speed of 210 RPM about its axis A.

The density of this FIG. 14 pattern shows the jets substantially uniformly impinging entirely across the area being treated. Unlike the prior art, concentration of jet impingement at the edges of the pattern has been moved inwardly and distributed across the treated area and yet the jet streams are maintained in substantial parallelism.

With reference to FIG. 9, the multiple orifice distribution head 158 is rotated about its common axis C by a hollow shaft 162. Hollow shaft 162 is driven by a variable speed hydraulic drive 168 through elliptical transmission gearing 170 best seen in FIG. 3. The elliptical transmission gearing 170 is defined by two elliptical gears 172 and 172', the latter being mounted on one end of hollow shaft 162 carried by a high pressure water swivel 174. The opposite end of the shaft 162 is threadably connected to the distribution block 176 in the head 158. The block 176 is carried by a needle bearing 178 supported within a stationary gear 180 whose peripheral teeth 182 mesh with the drive pinions 184 for each of the nozzles 152, best seen in FIG. 4.

Drive pinions 184 rotate about independent axes A as the head 158 rotates about central axis C, the result of the drive pinions meshing as they revolve about the stationary gear 180. A suitable high pressure seal is provided at 186. Another needle bearing and seal, not shown, support and seal the opposite end of shaft 162 in the swivel 174 adjacent gear 172'.

The distribution head 158 and water swivel 174, are mounted by support arms 188 which are pivotally supported at clevises 190 on a base 192. The head 158 is oscillated, in the arrangement shown, by a cam 194 mounted on the end of hollow shaft 162. Cam 194 works against a follower 196. A cam return cylinder 198 assures proper meshing of elliptical gears 172,172' as hydraulic drive 168 is operated.

The combination of elliptical transmission gearing 170 and cam-pivot mounting 194,190 which cause the head 158 to oscillate during operation provide a more concentrated jet cleaning pattern than is possible with a non-oscillating head 158 arrangement. The frequency and amplitude of oscillation is dependent upon the selection of elliptical gears 172,172' and the rotary speed of variable speed hydraulic drive 168.

In the preferred embodiment of the invention, the number of rotations of nozzles 152 about the independent axes A in relation to the revolution of the nozzles about the common axis C is an uneven ratio generally in the range of about 1.8 through 2.4 to 1. Most preferably, the ratio is generally in the range of about 2.1 to 1. Use of the preferred ratio creates a very dense water spray where the pattern of the water jets rotating and revolving is not duplicated.

In the preferred embodiment of the invention, the independent axes A are symmetrically radially spaced about the common axis C, as illustrated in FIG. 2, although the independent axes can be non-symmetrically radially spaced to provide a more random cleaning pattern.

Figure 4:
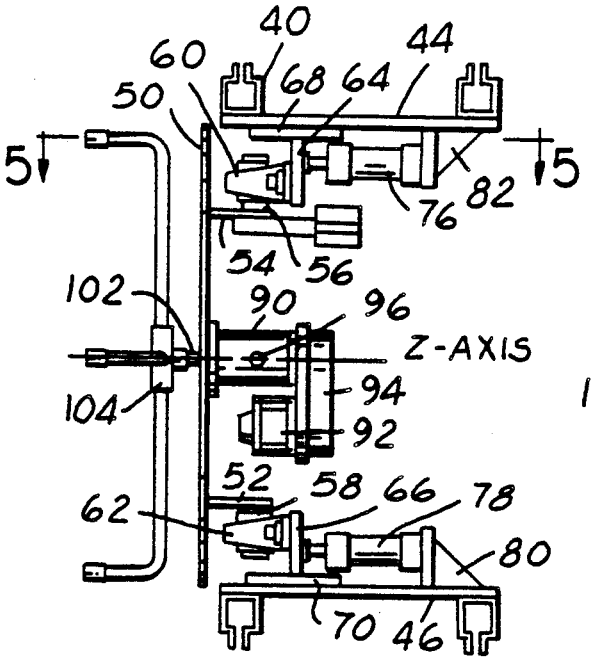
FIG. 4 is a side view of a nozzle assembly taken on the line 4—4 of FIG. 2 and showing how movement on the X axis may be accomplished.

The drive pinions 184 shown in FIG. 4 can be changed to change the ratio of nozzle 152 rotation to nozzle revolution.

Figure 5:
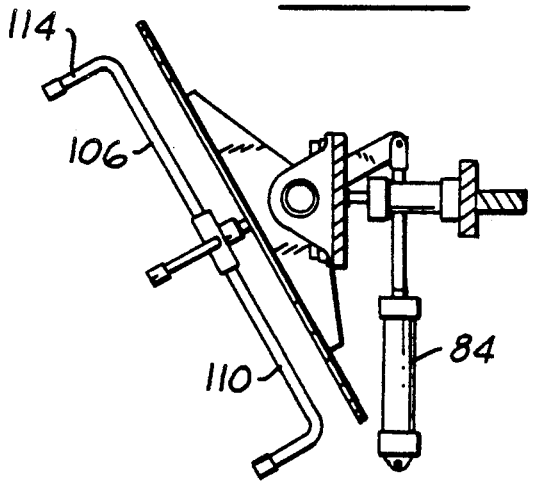
FIG. 5 is a top view of the nozzle assembly of FIG. 4 taken on the line 5—5 of FIG. 4 and illustrating how movement on the Y axis may be accomplished.

The water swivel 174 of the type shown in FIGS. 1 and 5 provides a connector and channel for getting the water from a stationary water supply, not shown, to the rotating multiple orifice distribution head 158.

While the best mode for carrying out the invention has been described in detail, those familiar with the art to which this invention relates will recognize alternative ways of practicing the invention as defined by the following claims.

What is claimed is:

1. An apparatus for high-pressure water cleaning comprising:

a high pressure nozzle having inlet and discharge ends;

said nozzle discharge end being displaced radially from and being rotatable about an independent axis;

said independent axis being arranged in radially spaced relation from a central axis and being parallel thereto;

a support for mounting the nozzle for rotation about said independent axis and also for revolution about said central axis;

said nozzle discharge end providing a water jet extending parallel to said independent and central axis; and a drive means for revolving the nozzle to move said independent axis about said central axis and rotate said nozzle about its independent axis independent of water delivery thereto whereby said discharge end provides a jet of water whose impingement pattern creates a uniform dense water cleaning spray.

2. Apparatus as in claim 1 wherein the number of rotations of said nozzle about said independent axis is related to the revolution of said nozzle about said central axis as an uneven ratio.

3. Apparatus as in claim 2 wherein said ratio is generally in the range of about 1.8 through 2.4 to 1.

4. Apparatus as in claim 3 wherein said ratio is generally in the range of about 2.1 to 1.

5. Apparatus as in claim 2 further including a plurality of high pressure nozzles each being radially displaced from and spaced apart about said independent axis.

6. Apparatus as in claim 5 wherein there are a plurality of said independent axes spaced radially from said central axis and said independent axes are non-symmetrically circumferentially spaced apart about said central axis.

7. Apparatus as in claim 5 wherein said independent axes are symmetrically circumferentially spaced about said central axis.

8. Apparatus as in claim 6 further including a support for mounting said nozzles for rotation about said independent axes and revolution about said central axis.

9. Apparatus as in claim 8 wherein said support is a multiple orifice distribution head having replaceable drive elements for changing the ratio of rotation to nozzle revolution.

10. Apparatus as in claim 9 further including a water swivel by which said multiple orifice distribution head is connected to provide a water connection for said head as it rotates.

11. Apparatus as in claim 1 wherein said drive means is variable to variably control the revolution of said nozzles.

12. Apparatus as in claim 1 wherein said drive is hydraulic.

13. A method of directing high-pressure water at articles comprising the steps of:

directing a jet of high-pressure water at each article while rotating the jet independently of water delivery thereto about and radially spaced from an independent axis, the axis of the jet being parallel to the axis of rotation;

while continuing to rotate the jet about said independent axis, revolving the jet independently of water delivery thereto about a central axis and parallel thereto and spaced radially from the independent axis; and controlling the rotation about the independent axis in relation to the revolution about the central axis as a predetermined ratio to provide a jet impingement pattern of predetermined controlled density at the surface of the article.

14. A method as in claim 13 further including the step of directing the jet at a selected area of the article and providing relative linear movement of the article and the jet to clean an area of the article impinged by the jet.

15. A method as in claim 14 wherein said relative movement is computer controlled.

16. A method as in claim 15 wherein said relative movement is programmable to provide movement in a generally linear and perpendicular fashion with respect to the area impinged by the jets to treat an elongated area along the article.

17. A method as in claim 16 further including the step of repositioning the jet to treat another discrete area of the article.

18. A method as in claim 17 further including the step of repeating the step of repositioning the jet until the entire article is treat.

* * * * *

UNITED STATES PATENT AND TRADEMARK OFFICE

CERTIFICATE OF CORRECTION

PATENT NO. : 4,989,785

DATED : February 5, 1991

INVENTOR(S) : Stanley J. Walendowski

It is certified that error appears in the above-identified patent and that said Letters Patent is hereby corrected as shown below:

Column 6, Line 11: Delete "136" and insert --131--.

Column 6, Line 63: Delete "Fig. 3" and insert --Figs. 10-13--.

Column 6, Line 68:after "distribution" delete --block 176 in the--.

Column 7, Line 4: Delete "4" and insert --12 and 13--.

Column 10, Line 5, claim 18, line 3 delete "treat and insert --treated--.

Signed and Sealed this

Fourth Day of August, 1992

*Attest:*

*Attesting Officer*

DOUGLAS B. COMER

*Acting Commissioner of Patents and Trademarks*